US006984821B1

(12) United States Patent
Appelhans et al.

(10) Patent No.: US 6,984,821 B1
(45) Date of Patent: Jan. 10, 2006

(54) MASS SPECTROMETER AND METHODS OF INCREASING DISPERSION BETWEEN ION BEAMS

(75) Inventors: Anthony D. Appelhans, Idaho Falls, ID (US); John E. Olson, Rigby, ID (US); James E. Delmore, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 0 days.

(21) Appl. No.: 10/870,856

(22) Filed: Jun. 16, 2004

(51) Int. Cl.
*H01J 49/48* (2006.01)
*H01J 49/32* (2006.01)

(52) U.S. Cl. ..... 250/294; 250/281; 250/282; 250/283; 250/296; 250/298; 250/396 R

(58) Field of Classification Search ..... 250/281, 250/282, 283, 294, 296, 298, 396 R
See application file for complete search history.

(56) References Cited

U.S. PATENT DOCUMENTS

| | | | | |
|---|---|---|---|---|
| 4,638,160 | A | 1/1987 | Slodzian et al. | 250/296 |
| 5,194,732 | A * | 3/1993 | Bateman | 250/294 |
| 5,220,167 | A * | 6/1993 | Brown et al. | 250/281 |
| 6,297,501 | B1 * | 10/2001 | Merren | 250/296 |

OTHER PUBLICATIONS

"Isotope Ratio Analysis of Low Abundance U Isotopes", *Thermo Finnigan MAT GmbH, Element 2 Application Flash Report No. E, 16*, 2002.

* cited by examiner

*Primary Examiner*—Nikita Wells
(74) *Attorney, Agent, or Firm*—Wells St. John

(57) ABSTRACT

A mass spectrometer includes a magnetic sector configured to separate a plurality of ion beams, and an electrostatic sector configured to receive the plurality of ion beams from the magnetic sector and increase separation between the ion beams, the electrostatic sector being used as a dispersive element following magnetic separation of the plurality of ion beams. Other apparatus and methods are provided.

32 Claims, 9 Drawing Sheets

MASS SPECTROMETER AND METHODS OF INCREASING DISPERSION BETWEEN ION BEAMS

GOVERNMENT RIGHTS

This invention was made with Government support under Contract No. DE-AC07-99ID13727 awarded by the U.S. Department of Energy. The Government has certain rights in the invention.

TECHNICAL FIELD

Aspects of the invention generally relate to mass spectrometers and methods of increasing dispersion between ion beams.

BACKGROUND OF THE INVENTION

Isotopic analysis of materials provides increased amount of information relative to information generated by traditional chemical analyses. Although qualitative and quantitative structural analyses identify the chemical composition of a compound or individual molecules of the compound, isotopic analysis provides additional information regarding the source, origin and formation of such compounds and molecules.

Mass spectrometers are well known and are used for wide ranging applications, such as isotope ratio monitoring, chemical analysis ranging from environmental analysis (e.g., detection of poisons) to the analysis of petroleum products, tracing of metals and biological materials. Mass spectrometers produce charged particles (e.g., ions) from chemical substances that are to be analyzed. After producing the ions, the mass spectrometers use electric and magnetic fields to measure the mass of the ions for isotope ratio monitoring.

Mass spectrometers are generally described in U.S. Pat. No. 4,638,160 to Soldzian et al. and U.S. Pat. No. 5,194,732 to Bateman, both of which are incorporated herein by reference. Mass spectrometers manufactured by Cameca are disclosed at www.cameca.fr, mass spectrometers manufactured by GV Instruments are disclosed at www.gvinstruments.co.uk, and mass spectrometers manufactured by Thermo Electron Co. are disclosed at www.thermo.com.

Design and construction of a mass spectrometer with high sensitivity to measure isotope ratios require compromises in design and construction. High absolute sensitivity and high abundance sensitivity are required to make isotope ratio measurements of elements with wide (e.g., $10^8$) isotope ratios. In order to make such measurements with an extremely small sample, it is necessary to simultaneously measure the isotopes.

For example, a wide dynamic range is required to determine weapon yield using ratios of $^{242}$Pu and $^{244}$Pu to $^{239}$Pu, and tailing from the major peak at 239 onto the small peaks must be limited (high abundance sensitivity) in order to make a meaningful measurement.

Samples having smaller sizes may produce signals with meaningful intensities for only a short period of time (e.g., minute or less). Signal intensity typically changes rapidly under such circumstances. Scanning mass spectrometers that can only measure one isotope at a time are at a disadvantage under these circumstances, since the signals from the isotopes of interest may have to be interpolated to obtain isotope ratios.

Prior mass spectrometers manufactured by such entities as Thermo Finnegan and GV Instruments use arrays of Faraday cups and are configured with miniaturized channeltron multipliers for pulse counting. Such channeltron multipliers have high background counts and no more than 70% efficiency. The high background counts tend to limit sensitivity. Mass spectrometers made by the above-noted entities do not have sufficient dispersion between adjacent isotopes to accommodate full-sized multipliers that have 100% efficiency and background levels of about 3 counts/minute.

Instruments used for isotope ratio measurements typically had a single magnetic sector. Such instruments operated in the scanning or peak stepping mode and were not practical to set up to collect an entire U or Pu spectrum simultaneously.

FIG. 1 shows a schematic of a prior art mass spectrometer 100 designed to measure the isotopic composition of a sample. The mass spectrometer 100 includes an ion source 102 configured to generate a beam of ions 104 that are characteristic of the various element(s) present in the sample whose isotopic composition is to be determined. The beam of ions 104 is received in a magnetic sector 106 which disperses such beams of ions into separate beams 108–110 of discrete mass-to-charge ratios. Beams 108–110 are respectively received by detectors 112–114, which are typically Faraday cup collectors. The isotopic composition of the element in question is determined by simultaneous measurement of signals generated by detectors 112–114. In the arrangement of FIG. 1, the mass dispersion of beams 108–110 is solely due to the magnetic sector 106.

FIG. 2 shows a schematic of another prior art mass spectrometer 200 having an ion source 202 that generates a beam of ions 204 that are dispersed by a magnetic sector 206 into a plurality of beams 207, 208 according to their mass-to-charge ratios. Beams 207, 208 enter an electrostatic analyzer 210 which cooperates with the magnetic sector 206 to produce an image on detector 212, the image being focused both in velocity and direction. The mass spectrometer 200 includes a detector 216 for detecting different isotopes of a sample. The electrostatic analyzer 210 is used for double focusing to be maintained over a wide range of deflection angles and focal lengths of the electrostatic analyzer 210. The dispersion of beams 209, 211 exiting the electrostatic analyzer 210 is solely due to the magnetic sector 206. The electrostatic analyzer 210 is used to provide energy focusing of the ion beams in order to filter out ions that have scattered off of internal walls of the mass spectrometer vacuum housing or ions that have scattered due to collisions with residual gas in the vacuum system.

Prior approaches necessitate use of miniaturized detectors that are less than 100% efficient and have a high background noise level. Individual ion beams cannot readily be separated far enough apart to allow use of full sized Faraday cups or discrete dynode pulse counting detectors for each separated beam with existing approaches.

FIG. 2*a* shows a schematic of a prior art commercial isotope ratio mass spectrometer having an ion source 202 that generates a beam of ions 204 that are dispersed by a magnetic sector 206 into a plurality of beams B according to their mass to charge ratios. Beams B are simultaneously focused by the magnetic sector 206 into multiple miniature faraday cup collectors C, with one of the beams being focused into a miniature electron multiplier C1.

SUMMARY OF THE INVENTION

Aspects of the invention generally relate to high dispersion mass spectrometers and methods of increasing dispersion between adjacent ion beams. Aspects of the invention relate to a mass spectrometer having sufficient dispersion to accommodate full-sized discrete dynode multipliers for simultaneously measuring adjacent isotopes.

Aspects of the invention also relate to a mass spectrometer configured to separate individual ion beams by multiple centimeters to enable the use of high efficiency and low-noise detectors.

In one aspect, a mass spectrometer includes a magnetic sector configured to separate a plurality of ion beams, and an electrostatic sector configured to receive the plurality of ion beams from the magnetic sector and increase separation between the ion beams, the electrostatic sector being used as a dispersive element following magnetic separation of the plurality of ion beams. The dispersive element herein after referred to as the electrostatic dispersion lens (EDL).

In another aspect, a mass spectrometer includes a first device configured to separate a plurality of ion beams of a sample, and a second device configured to receive the plurality of ion beams from the first device and to increase separation between the ion beams for simultaneously measuring the plurality of ion beams, the increased separation enabling a plurality of isotopes of the sample to be simultaneously measured.

In yet another aspect, a mass spectrometer for measuring isotope ratios of elements of a sample includes an ion source configured to produce a plurality of ion beams from the sample, a magnetic sector having an exit, and having an entrance positioned to receive the plurality of ion beams from the ion source. The magnetic sector is configured to separate the plurality of ion beams using magnetic separation into individual ion beams, one of the individual ion beams being separated from a second one of the individual ion beams at the exit of the magnetic sector by a first distance. The mass spectrometer also includes an electrostatic sector having an exit, and having an entrance configured to simultaneously receive the plurality of ion beams from the magnetic sector. The electrostatic sector is configured as an EDL to produce an increased separation between the adjacent ion beams, one of the ion beams being separated from another one of the ion beams by a second distance, greater than the first distance, following the exit of the electrostatic sector. The electrostatic sector is used as a dispersive element, following the magnetic separation of the plurality of ion beams, to achieve the increased separation. The mass spectrometer also includes a plurality of deflection electrostatic sectors individually configured to receive a separated ion beam from the electrostatic sector and to further increase the separation between the adjacent ion beams, and a plurality of detectors, each of the detectors associated with a respective deflection electrostatic sector of the plurality of deflection electrostatic sectors. Each of the plurality of ion beams enters the electrostatic sector at a different physical location and wherein the beams are dispersed at different angles upon exiting the electrostatic sector. The electrostatic sector produces increased dispersion of each of the plurality of ion beams exiting the electrostatic sector for simultaneously measuring isotopes of the sample.

In a further aspect, a method of increasing separation between ion beams in a mass spectrometer includes receiving a plurality of ion beams of a sample, magnetically separating the plurality of ion beams, simultaneously receiving the magnetically separated ion beams in an electrostatic sector, and increasing the separation between the ion beams using the electrostatic sector, the electrostatic sector being used as a dispersive element following the magnetic separation of the ion beams.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
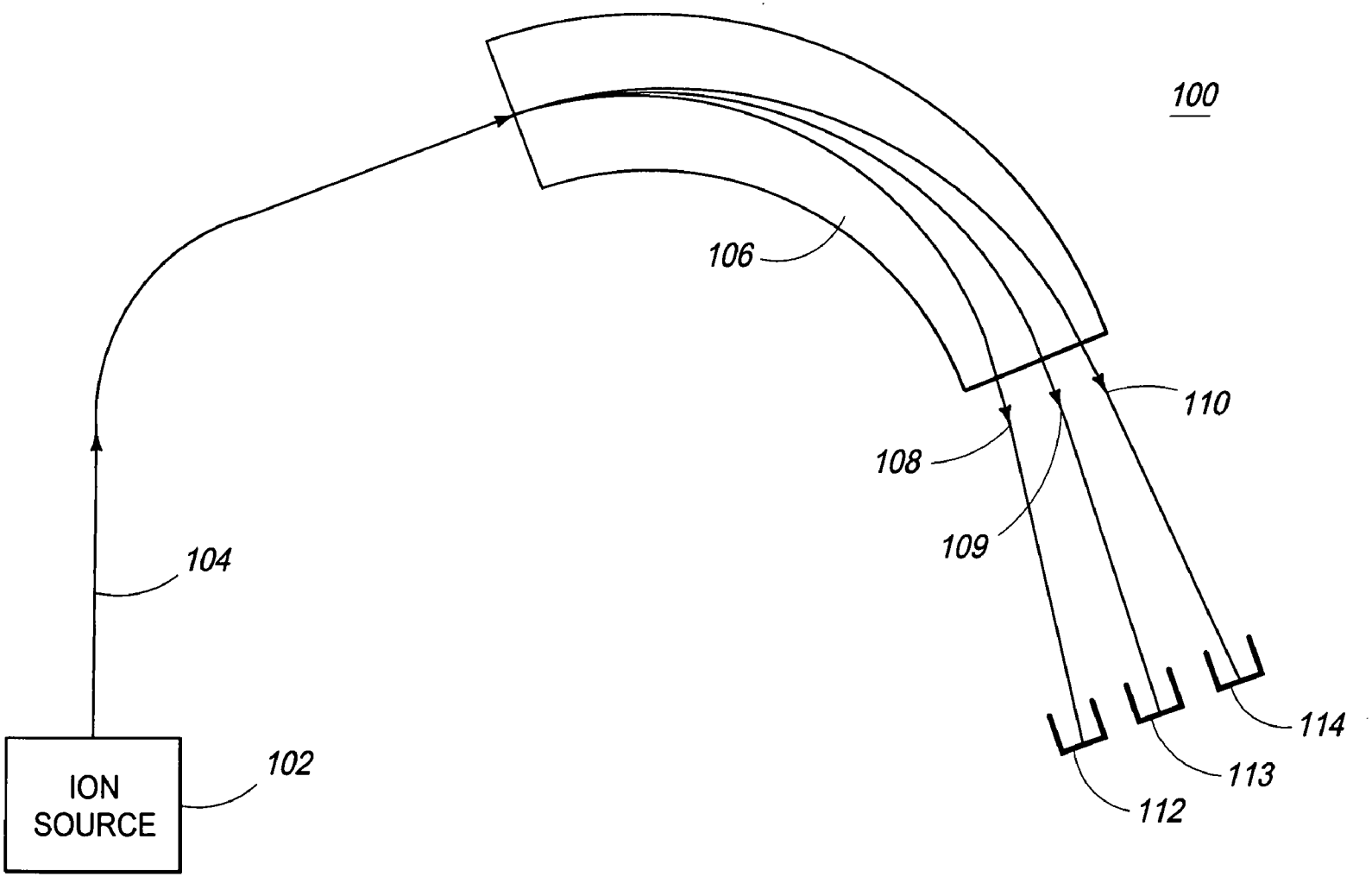
FIG 1 PRIOR ART
FIGS. 1–2*a* show schematics of prior art mass spectrometers.
Figure 2:
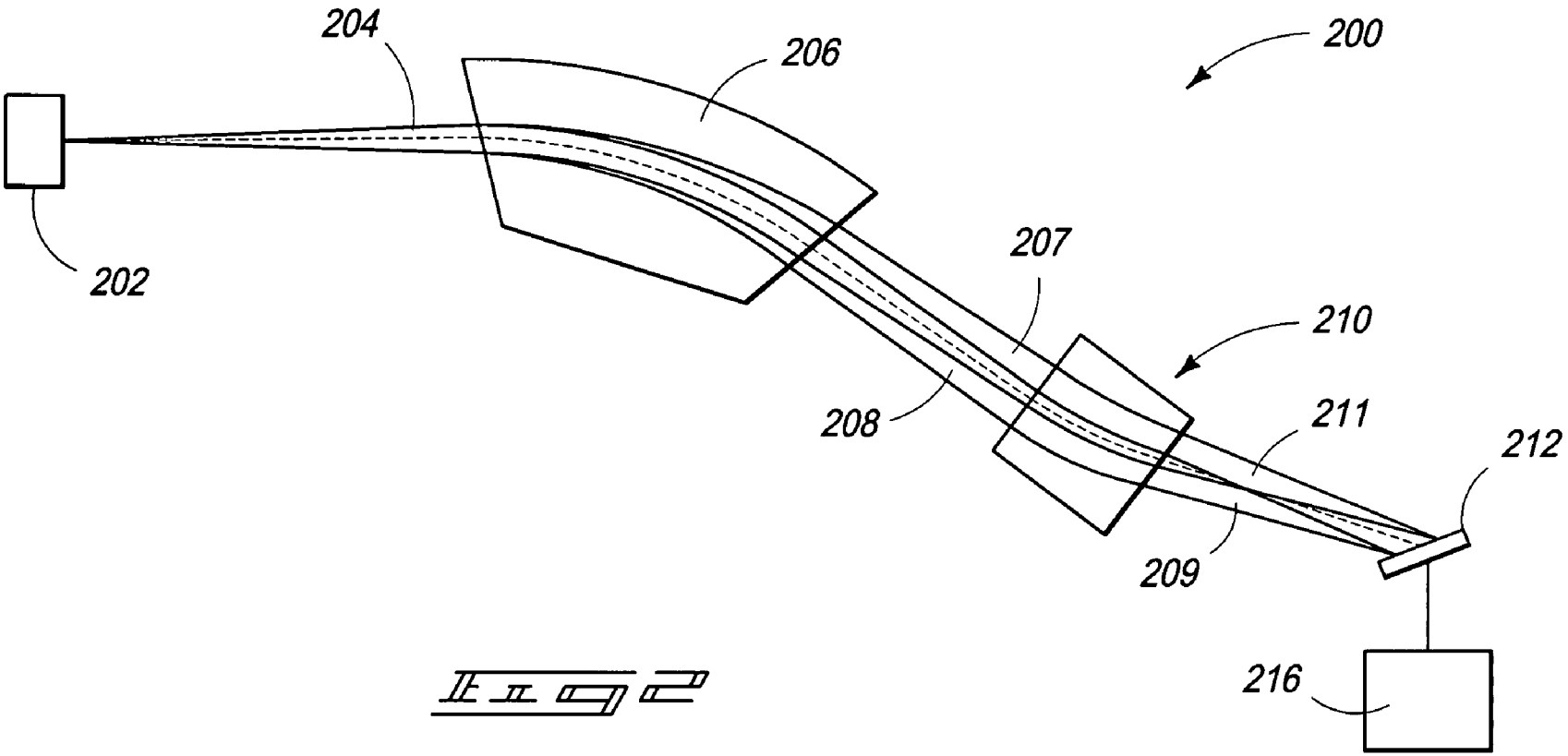
FIG 2 PRIOR ART
Figure 2A:
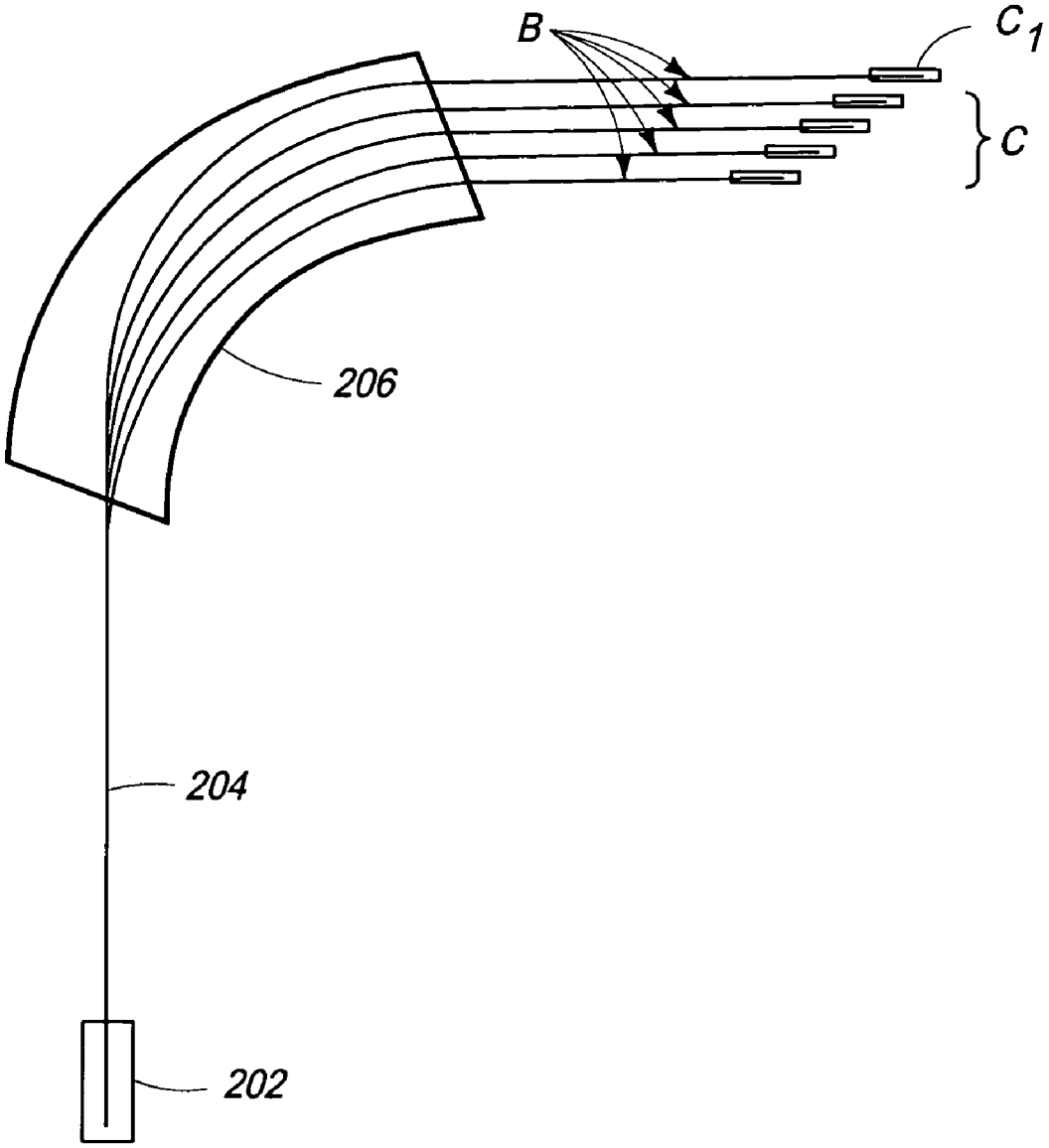
FIG 2A PRIOR ART
Figure 3:
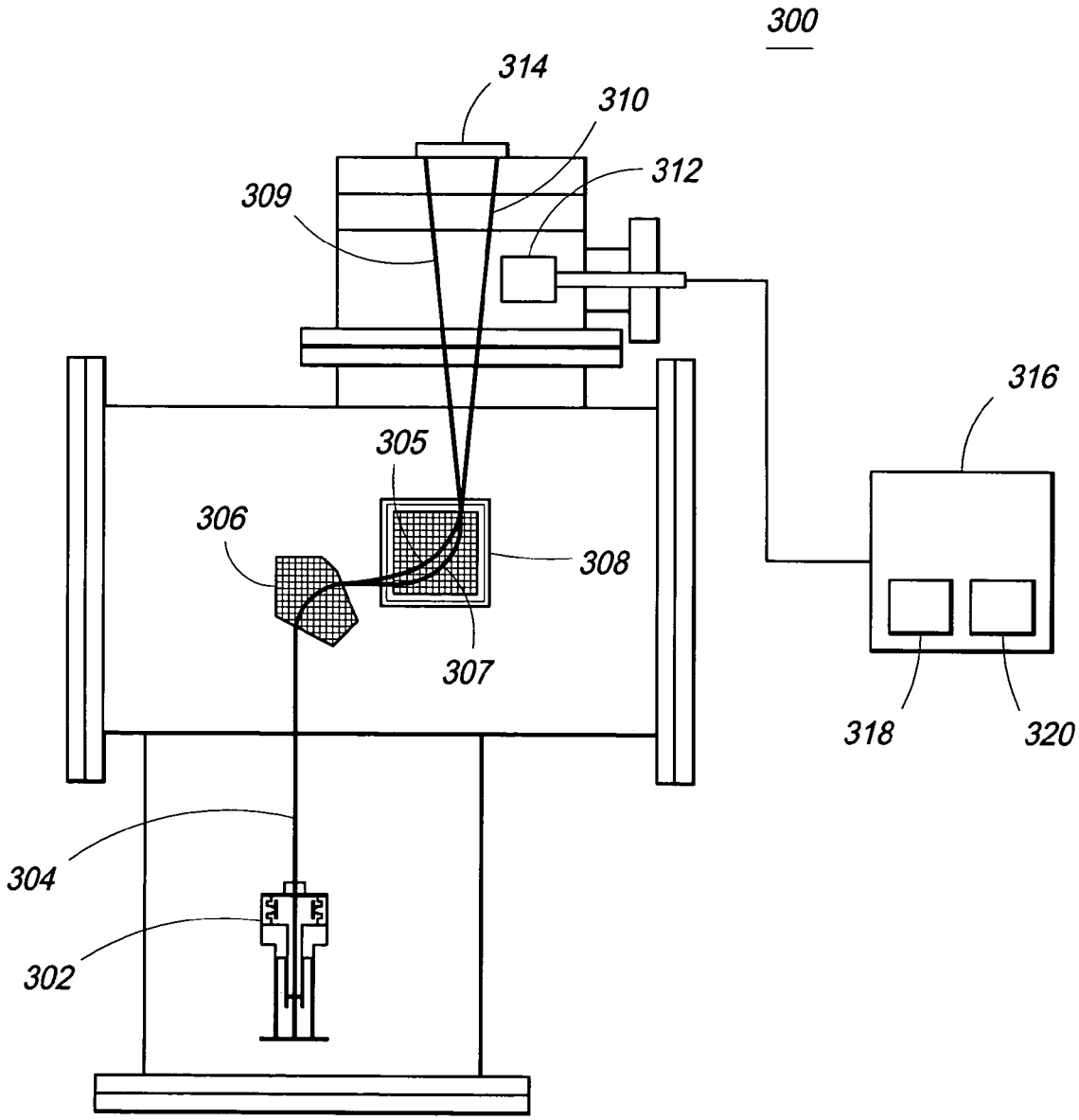
FIG. 3 is a schematic of a wide dispersion mass spectrometer in accordance with some embodiments of the invention.

FIG. 3 shows a wide dispersion mass spectrometer 300 illustrating the main components of a mass spectrometer embodying various aspects of the invention. An ion source 302 generates a beam of ions (e.g., charged particles) 304. The mass spectrometer includes a magnetic sector 306, and an electrostatic sector 308 configured as an EDL. A plurality of ion beams 309, 310 are magnetically separated by the magnetic sector 306. The electrostatic sector 308 receives the plurality of beams from the magnetic sector 306 and the electrostatic sector 308 increases separation between the ion beams. The mass spectrometer also includes a Faraday cup detector 312, and a multichannel plate (MCP) detector having screen 314.

The ion source 302 is configured to provide stable ion currents. The beams of ions 304 generated by the ion source 302 are focused and accelerated using an ion gun (e.g., univoltage ion gun). For example, the ion source 302 may comprise Li-zeolite powder that is pressed into a platinum tube (not shown) which is spot welded to small diameter rhenium wire mounts configured to serve as a heater. Heating of the platinum tube results in emission of a beam of Li ions (e.g., beams 304). Alignment of the beams of ions 304 with the magnetic sector 306 may be accomplished mechanically. Such details are not relevant to the invention and are therefore not discussed in detail here.

The magnetic sector 306 includes a magnet whose included angle results in a magnetic field that maintains stigmatic focusing of the beams of ions 304. In one example, the included angle of the magnetic sector 306 may be 54 degrees. In one case, the inventors have observed that for a magnetic field strength of about 4.15 kG, the magnetic sector 306 mass separated $^{6}Li^{+}$ from $^{7}Li^{+}$ at an energy of about 1600 electron volts.

The magnetic sector 306 has non-normal entrance and exit shims to provide Z-focusing. For example, if a plutonium sample is used, the ion beams having 238–244 isotopes may be generated and the magnetic sector 306 mass separates the 238–244 isotopes of the plutonium sample. A physical beam slit "S" (FIG. 4) only permits beams of ions of the mass range of interest to pass to the electrostatic sector 308. A magnet flight tube (not shown) may be configured to include extensive baffling to inhibit charged particle scattering so that the ion beams will be as clean as possible to achieve high abundance sensitivity.

The electrostatic sector 308 is configured as an EDL to provide magnified angular dispersion for the mass separated ion beams 305, 307 that are received from the magnetic sector 306. The electrostatic sector 308 includes electrodes (e.g., two at least generally right-cylinder shaped electrodes) held at opposite potentials. Further details of the electrostatic dispersion lens 308 are described with reference to FIGS. 5*a*–5*f*.

The Faraday cup collector 312 includes a secondary electron suppression grid and ground shield (not shown) and is used to measure beam current of the ion beams 309, 310 exiting the electrostatic sector 308.

A multichannel plate detector may be coupled to the screen 314 (e.g., phosphor screen), that retains spatial information, via a fiber optic bundle. In one example, the inventors have conducted measurements by adjusting the voltage of the ion source 302 such that both the $^{6}Li^{+}$ from $^{7}Li^{+}$ ion beams were visible on the screen 314. The beam current was measured with the Faraday cup detector 312 as a function of lateral position. Such measurement enables both the individual width of the beams (e.g., 309, 310) and their relative spacing (e.g., dispersion) to be determined. The Faraday cup measurements were made using a Keithley model electrometer connected to a computer system 316 having a processor 318 and a memory or storage device 320. A data acquisition program embodied in the computer system 316 was used to record the electrometer signals as a function of the Faraday cup position. Typical ion currents for $^{7}Li^{+}$ were observed to be in the range of 50–100 pA. Residual gas pressure during the measurement was observed to be $3\times10^{-6}$ Torr.

Figure 4:
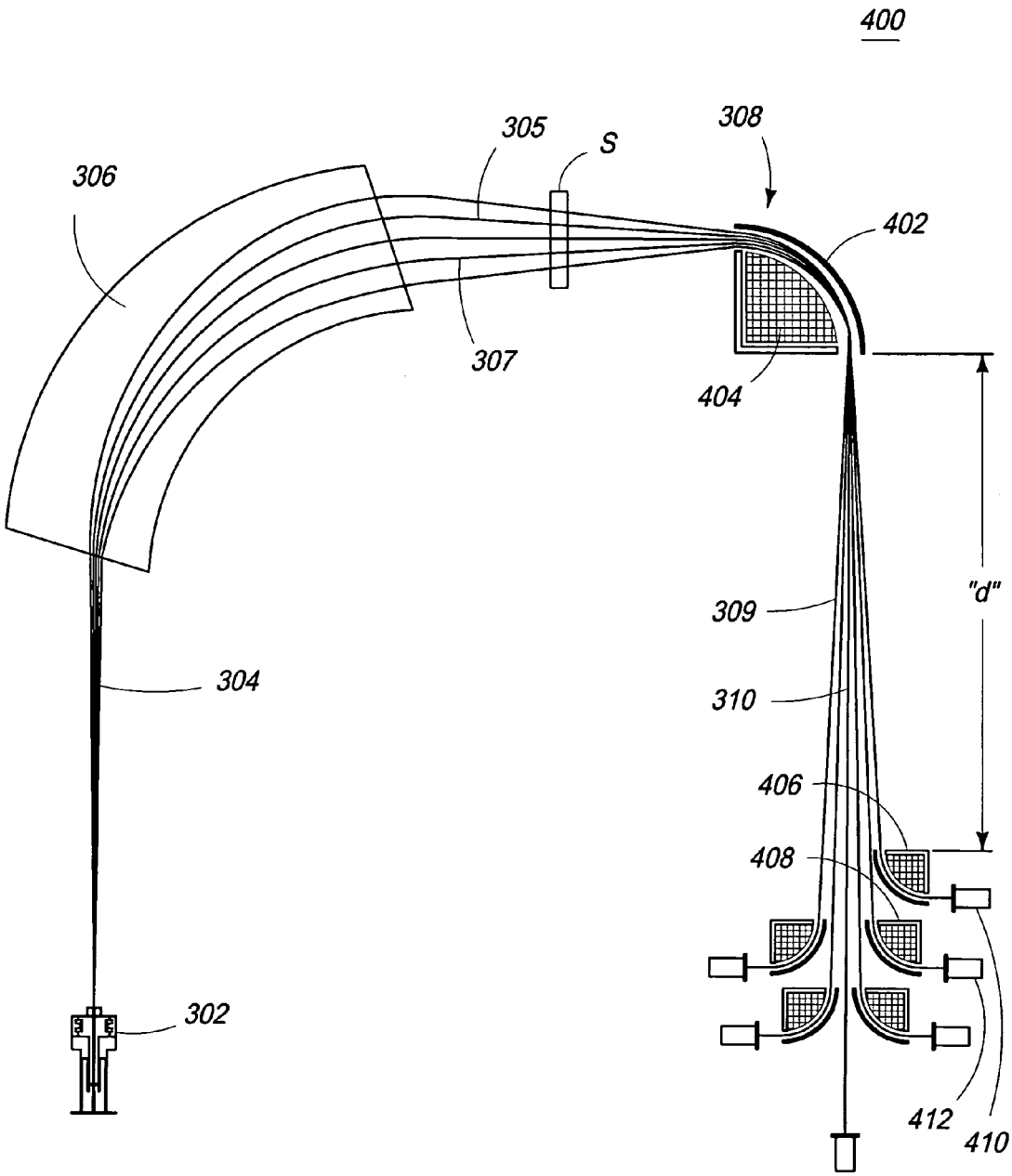
FIG. 4 is a schematic of a wide dispersion mass spectrometer in accordance with other embodiments of the invention.

FIG. 4 is a schematic of a wide dispersion mass spectrometer in accordance with other embodiments of the invention wherein elements like those shown in FIG. 3 are identified using similar reference numerals. Specifically, FIG. 4 shows ion beam trajectories through the mass spectrometer wherein the plurality of ion beams are simultaneously detected.

In the embodiment of FIG. 4, a slit "S" is positioned after the magnetic sector 306 such that all the ion beams for the mass range of interest (e.g., 305, 307) from the magnetic sector 306 pass through the slit "S" and simultaneously enter the electrostatic sector 308. For simplicity, only a limited number of ion beams are identified using reference numerals. As such, more or less number of ion beams may be produced by the ion source 302. The number of beams emitted from the ion source 302 may be a function of the number of isotopes present in a measurement sample. The electrostatic sector 308 includes an outer electrode 402 and an inner electrode 404. Voltages are applied to the outer and inner electrodes 402, 404, respectively such that ion beams 309, 310 upon exit are additionally dispersed relative to the dispersion of ion beams 305 and 307. The mass spectrometer 400 also includes a plurality of deflection electrostatic sectors (e.g., deflection lens) 406, 408, and a plurality of detectors 410, 412.

The ion beams 305, 307 after passing through the slit "S" simultaneously enter the electrostatic sector 308 at different spatial positions. As the ion beams 305, 307 enter the electrostatic sector 308 at different spatial positions, they follow different trajectories through the electrostatic sector 308 and are further dispersed (e.g., separated relative to adjacent ion beams) on exiting the electrostatic sector 308. The dispersed ion beams are shown using reference numerals 309, 310. As noted above, the angular dispersion between the ion beams 309, 310 that exit the electrostatic sector 308 is greater than the angular dispersion between the ion beams 305, 307 that enter the electrostatic sector 308.

The dispersion of the ion beams 309, 310 increases with distance as the beams move away from the electrostatic sector 308. At a predetermined distance "d" from the exit portion of the electrostatic sector 308, the space between the ion beams 309, 310 increases to a point where each of such ion beams can be deflected using a deflection electrostatic sector (e.g., 402, 404) to be received by a discrete-dynode multiplier. Such further dispersion provides sufficient space for configuring individual detectors (e.g., 403, 405) for each isotope of a sample and an additional filter against scattered ions to maintain high abundance sensitivity while permitting simultaneous detection of all of the isotopes of the sample.

The deflection sectors 406, 408 may be configured as miniature versions of the electrostatic sector 308, the details of which have been described above with reference to FIG. 3. Other than the size, the deflection sectors 406, 408 can be substantially similar to the electrostatic sector 308.

The number of deflection sectors (e.g., 406, 408) and the detectors (e.g., 410, 412) are shown to be merely exemplary. As such, more or less number of deflection sectors and detectors are possible and such may be configured to be proportional to the number of ion beams generated by the ion source 302. The embodiment of the mass spectrometer shown in FIG. 4 eliminates magnet tracking which is typically found to be a requirement with earlier known high abundance sensitivity tandem magnet instruments.

The electrostatic sector 308 acts as a dispersing lens, rather than a focusing energy filter, in order to magnify or increase the separation between adjacent ion beams (e.g., ion beams 305, 307). The magnified dispersion enables the individual ion beams (e.g., ion beams 305, 307) to be deflected to individual detectors (e.g., 410, 412) thereby enabling such individual ion beams to be separately measured with increased precision.

The position and the included angle of the electrostatic sector 308 may be varied to increase the performance of the mass spectrometer 400. The mass spectrometer 400 may be used with other samples (e.g., Uranium) by changing the magnetic field (e.g., to move the mass from 239 to 233 with other masses moving proportionally). If the masses are sufficiently similar, then the spacing between the collectors (e.g., detectors 410, 412) may be left unchanged. For example, in the case of adapting the mass spectrometer from Pu to U, the spacing between the collectors (e.g., 410, 412) may not have to be altered.

FIGS. 5*a*–5*f* illustrate dispersion between mass separated beams, in the electrostatic sector shown in FIG. 4, as a function of the separation of the beams at the entrance of the electrostatic sector 308 in accordance with various embodiments of the invention.

Figure 5A:
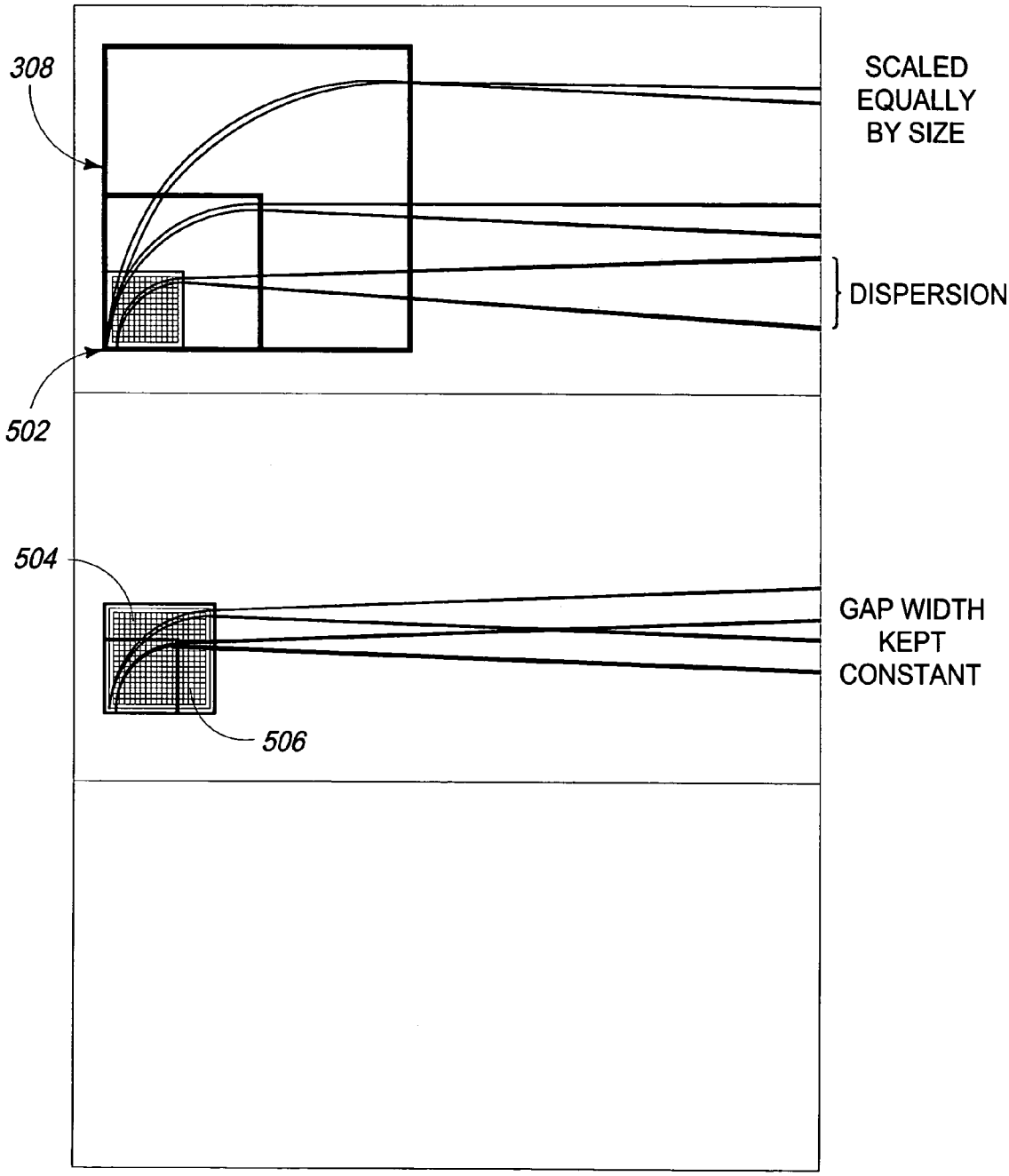
FIGS. 5*a*–5*f* illustrate dispersion between mass separated beams as a function of separation of the beams at the entrance of the electrostatic sector in accordance with various embodiments of the invention.

Referring to FIG. 5*a*, dispersion between mass separated beams in the electrostatic sector 308 is a function of the separation of the beams at the entrance 502 of the electrostatic sector 308. The separation at the entrance 502 of the electrostatic sector 308 is proportional to the dispersion at the exit of the electrostatic sector 308. Thus, in some embodiments, the electrostatic sector 308 is optimized based on the number of isotopes to be measured and the dispersion of the magnetic sector 306 (FIG. 4).

Since the individual ion beams are diverging after the focal plane of the magnetic sector (e.g., broadened) as well, in some embodiments it is preferred to place the electrostatic sector 308 in a position where the ratio of the ion beam separation to ion beam width is the greatest and the ion beam angular divergence is low. In some embodiments, the ion beams focus just prior to the entrance 502 to the electrostatic sector 308.

In some embodiments, for a constant gap width between plates 504 and 506 of the electrostatic sector 308, the radius of the electrostatic sector 308 formed by the plates 504, 406 is inversely proportional to the dispersion, for a given separation between the ion beams (e.g., 305, 307).

Figure 5B:
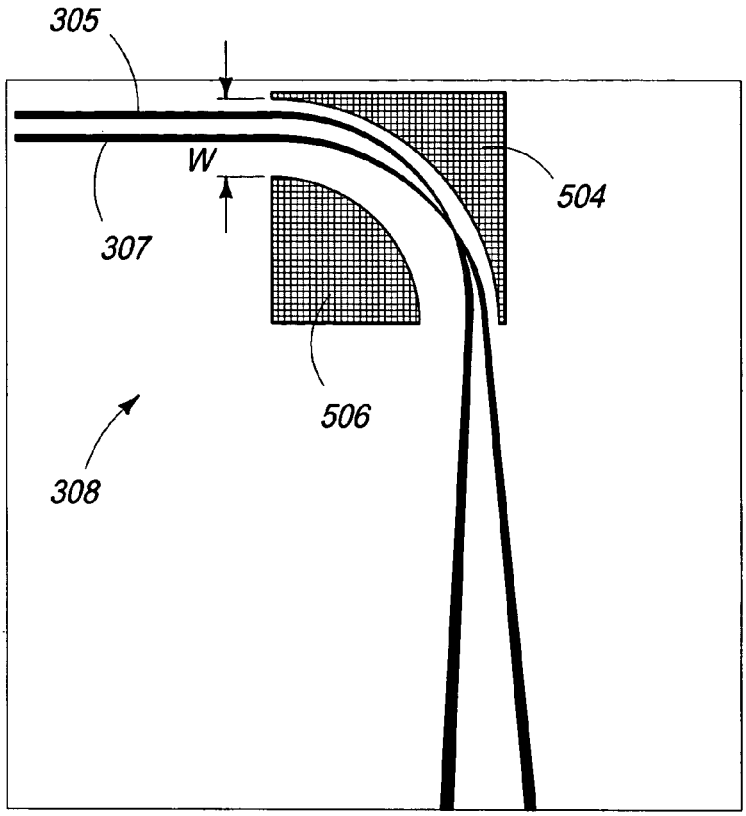
Figure 5C:
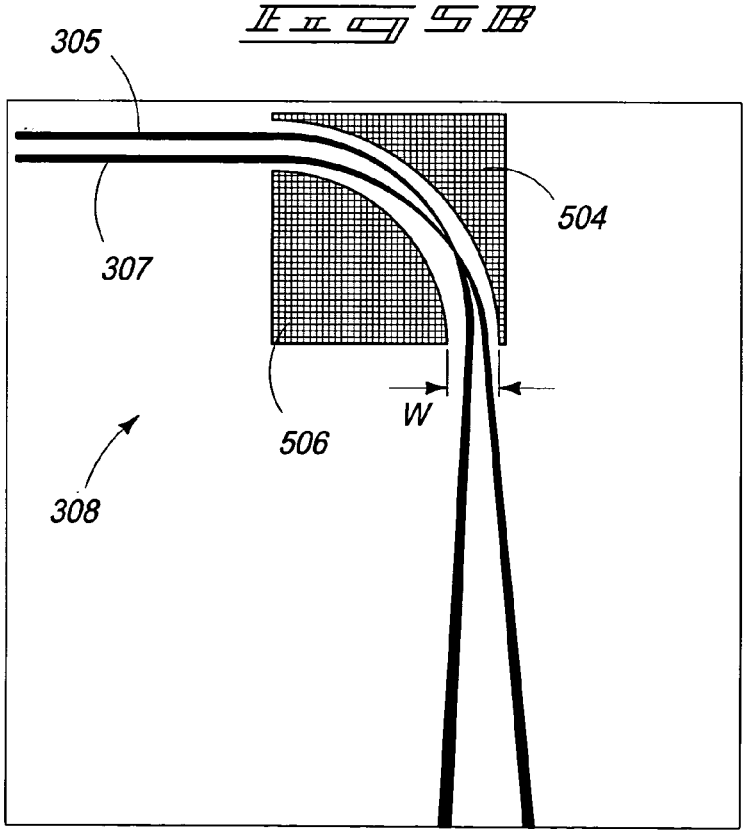

Referring to FIGS. 5*b* and 5*c*, the gap width "w" was found to have no effect on the dispersion for the ion beams (e.g., 305, 307) entering on axis with no angular divergence. However, with increasing width "w", higher voltage may have to be provided to the plates 504, 506 of the electrostatic sector 308. A comparison of FIGS. 5*b* and 5*c* reveals that as the gap "w" between the plates 504 and 506 is increased by about 50% relative to the gap between the plates 504 and 506, the inventors have observed that the narrow gap "w" of FIG. 5*c* required about 1350 volts for a 5 kV beam and the wider gap "w" of FIG. 5*b* required about 1900 volts for a 5 kV beam—the dispersion and the width of the ion beams (e.g., 305, 307) being unchanged.

Figure 5D:
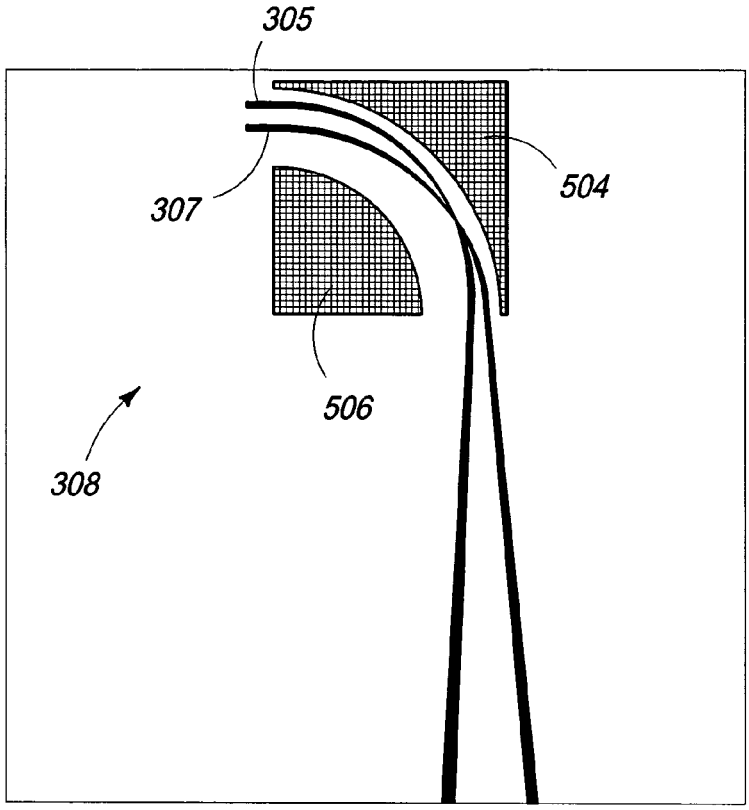
Figure 5E:
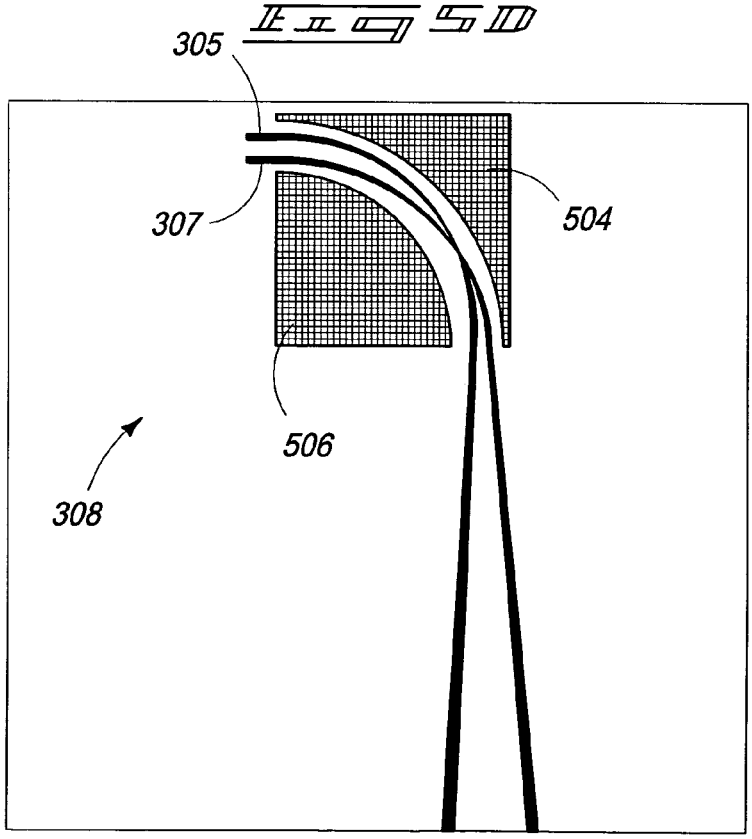

The gap width "w" between the ion beams was found to have an effect on the beam width when the ion beams (e.g., 305, 307) entering the electrostatic sector 308 have an angular divergence and focus prior to their entry into the electrostatic sector 308. Such is demonstrated in FIGS. 5*d* and Se. As shown in FIG. 5*d*, a wider gap width "w" produces a wider beam. In one exemplary case, for ion beams of 5 kV separated by 10 mm and with one degree beam divergence at the entrance to the electrostatic sector, and for a narrow gap width "w" between the plates 504 and 506, the beam divergence angle was observed to be 1.7 degrees and the center-to-center dispersion was observed to be 36.2 mm. For similar ion beams and for a wide gap width "w" between the plates 504 and 506, the included angle and the center-to-center dispersion were observed to be 1.86 and 35.8 mm, respectively. Accordingly, the gap width "w" between the plates 504 and 506 is as narrow as possible, in some embodiments.

Figure 5F:
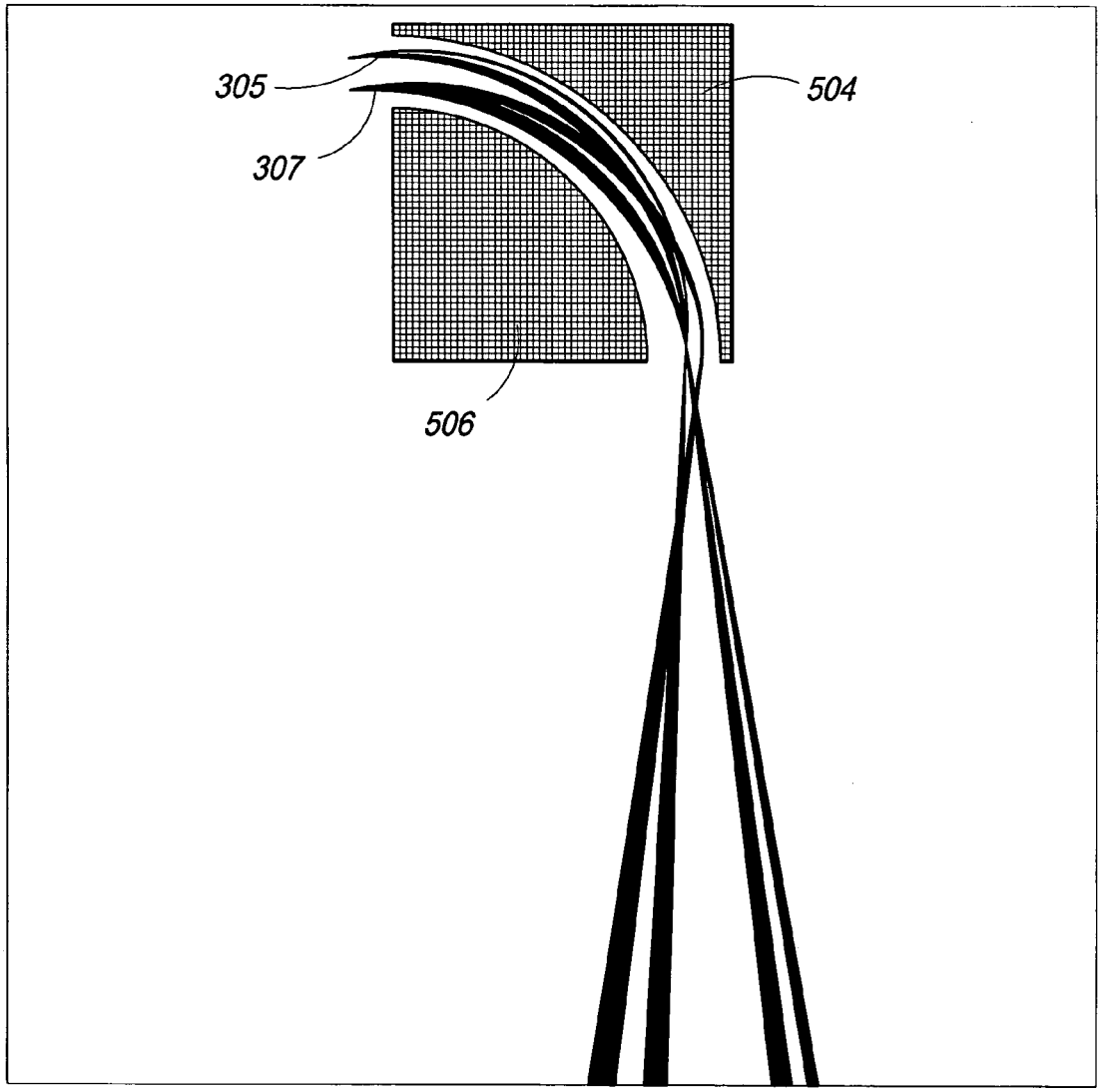

As shown in FIG. 5*f*, increased angular dispersion of the ion beams (e.g., 305, 307) was observed by the inventors to have resulted in increased dispersion.

Other features that are relevant to the design of the electrostatic sector 308 include height-to-width ratio of the gap width "w". For example, for an electrostatic sector that having a height-to-width ratio of 5, and a beam height to gap ratio of 1/10, the electrostatic sector may be offset by +/−1 beam height with no significant distortion. Thus, in some embodiments, the ability to align the electrostatic sector's vertical centerline is evaluated in order to configure it at a height that would accommodate the expected beam size and positioning accuracy.

Aspects of the invention offer various advantages, which in some embodiments include using a Z-focusing magnet, simultaneous detection of multiple isotopes with full-sized, high efficiency multipliers that are fully shielded in separate chambers, high transmission efficiency from the ion source to the detector chambers, high abundance sensitivity, and high sensitivity. Other advantages include ability to employ the total evaporation method without any peak jumping, and the ability to make the measurements with a small sample.

Advantages of the wide dispersion design of the mass spectrometer as described above in some embodiments and applicable to scanning triple sector instruments include simultaneous detection of all relevant isotopes. For example, if there are six isotopes being measured, simultaneous ion counting of all six isotopes provides more than six times sensitivity corresponding to the time expended in measuring individual isotopes. The sensitivity enhancement is more than six due to the settling time required between peak steps.

Advantages of various other aspects of the invention as applied to large magnet multi-sector instruments include providing adequate space for complete shielding between individual dynode multipliers in order to minimize stray ions and electrons from interfering with the measurement of minor isotopes. In prior approaches, such stray ions and electrons were found to decrease the abundance sensitivity of the instruments. The wide dispersion design of the various aspects of the invention provides a relatively short flight path coupled with the energy filtering inherent in the small electrostatic sector at the entrance to each detector chamber, thereby providing abundance sensitivity on the order of $10^6$, for example.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A mass spectrometer, comprising:

a magnetic sector configured to separate a plurality of ion beams; and an electrostatic sector, including an electrostatic dispersion lens, configured to receive the plurality of ion beams from the magnetic sector at different physical locations and to increase separation between the ion beams without regard to energies of ions in the beams, the electrostatic sector being used as a dispersive element following magnetic separation of the plurality of ion beams.

2. The mass spectrometer of claim 1, further comprising:

an ion source configured to receive a sample and to produce the plurality of ion beams; and a plurality of deflection sectors, each of the deflection sectors being configured to receive a separated ion beam from the electrostatic sector and to further increase the separation between the ion beams, the further increased separation being sufficient to enable the plurality of ion beams to be simultaneously measured.

3. The mass spectrometer of claim 1, wherein each of the plurality of ion beams enters the electrostatic sector at a different physical location and is dispersed at a different angle upon exiting the electrostatic sector, the dispersive action of the electrostatic sector maintaining mass separation of each of the plurality of ion beams while producing the increased separation between the ion beams.

4. The mass spectrometer of claim 3, wherein the increased separation between the ion beams enables the use of pulse counting multipliers to increase sensitivity and abundance sensitivity of the mass spectrometer.

5. The mass spectrometer of claim 3, further comprising pulse counting multipliers configured to increase sensitivity and abundance sensitivity of the mass spectrometer.

6. The mass spectrometer of claim 1, wherein the electrostatic sector comprises a cylindrical deflection lens having a radius of curvature "r".

7. The mass spectrometer of claim 1, further comprising a slit located such that all of the plurality of ion beams pass through the slit.

8. The mass spectrometer of claim 7, wherein the electrostatic sector comprises two generally cylindrical sections, each section being held at a different voltage in order to cause the plurality of ion beams to follow the different trajectories.

9. A mass spectrometer, comprising:

a first device configured to separate a plurality of ion beams of a sample; and a second device configured to receive the plurality of ion beams from the first device and to increase separation between the ion beams, without regard to the energy of ions in the beams, for simultaneously measuring the plurality of ion beams, the increased separation enabling a plurality of isotopes of the sample to be simultaneously measured.

10. The mass spectrometer of claim 9, further comprising:

an ion source configured to receive the sample to produce the plurality of ion beams; and a third device including a plurality of apparatus, each apparatus of the third device being configured to receive a separated ion beam from the second device and to further increase the separation between the ion beams.

11. The mass spectrometer of claim 10, further comprising a plurality of detectors, each of the detectors being configured to receive an ion beam output from a corresponding apparatus of the third device.

12. The mass spectrometer of claim 10, wherein the third device comprises deflection electrostatic sectors.

13. The mass spectrometer of claim 10, wherein the third device comprises deflection dispersion lenses.

14. The mass spectrometer of claim 9, wherein the first device is configured to simultaneously inject the plurality of ion beams into the second device.

15. The mass spectrometer of claim 9, wherein each of the plurality of ion beams enters the second device at a different physical location and is dispersed at a different angle upon exiting the second device, the dispersive action of the second device maintaining mass separation of each of the plurality of ion beams while producing the increased separation between the ion beams.

16. The mass spectrometer of claim 9, wherein the increased separation between the ion beams is sufficient to enable the use of pulse counting multipliers to increase sensitivity and abundance sensitivity of the mass spectrometer.

17. The mass spectrometer of claim 9, further comprising pulse counting multipliers to increase the sensitivity and abundance sensitivity of the mass spectrometer.

18. The mass spectrometer of claim 9, wherein the first device comprises a magnetic sector configured to separate distinct isotopes of the sample into separate ion beams.

19. The mass spectrometer of claim 9, wherein the second device comprises a cylindrical dispersion lens having a radius of curvature "r".

20. The mass spectrometer of claim 9, further comprising a slit disposed between the first and second devices, wherein all of the plurality of ion beams output from the first device pass through the slit.

21. The mass spectrometer of claim 9, wherein the second device comprises an electrostatic sector, the electrostatic sector being configured to receive each of the plurality of ion beams at different spatial positions and following different trajectories to further increase the separation between the adjacent ion beams exiting the electrostatic sector.

22. The mass spectrometer of claim 21, wherein the electrostatic sector comprises two at least generally cylindrical sections, each section being held at a different voltage in order to cause the plurality of ion beams to follow the different trajectories.

23. A mass spectrometer for measuring isotope ratios of elements of a sample, comprising:

an ion source configured to produce a plurality of ion beams from the sample;

a magnetic sector having an exit, and having an entrance positioned to receive the plurality of ion beams from the ion source, the magnetic sector being configured to separate the plurality of ion beams using magnetic separation into individual ion beams, one of the individual ion beams being separated from a second one of the individual ion beams at the exit of the magnetic sector by a first distance;

an electrostatic sector having an exit, and having an entrance configured to simultaneously receive the plurality of ion beams from the magnetic sector, the electrostatic sector being configured to produce an increased separation between the adjacent ion beams, one of the ion beams being separated from another one of the ion beams by a second distance, greater than the first distance, at the exit of the electrostatic sector, the electrostatic sector being used as a dispersive element, following the magnetic separation of the plurality of ion beams, to achieve the increased separation without regard to energies of ions in the ion beams;

a plurality of deflection electrostatic sectors individually configured to receive a separated ion beam from the electrostatic sector and further increase the separation between the adjacent ion beams; and a plurality of detectors, each of the detectors being associated with a respective deflection electrostatic sector of the plurality of deflection electrostatic sectors, wherein each of the plurality of ion beams enters the electrostatic sector at a different physical location and wherein the beams are dispersed at different angles upon exiting the electrostatic sector, the electrostatic sector producing increased angular dispersion of each of the plurality of ion beams exiting the electrostatic sector for simultaneously measuring isotopes of the sample.

24. The mass spectrometer of claim 23, wherein the electrostatic sector comprises a cylindrical deflection lens having a radius of curvature "r".

25. The mass spectrometer of claim 24, wherein the electrostatic sector comprises two at least generally cylindrical sections, each section being held at a different voltage to cause the plurality of ion beams to follow different trajectories through the electrostatic sector.

26. The mass spectrometer of claim 23, wherein the increased dispersion between the adjacent ion beams enables the use of pulse counting multipliers to increase sensitivity and abundance sensitivity of the mass spectrometer.

27. The mass spectrometer of claim 23, further comprising pulse counting multipliers to increase sensitivity and abundance sensitivity of the mass spectrometer.

28. A method of increasing separation between ion beams in a mass spectrometer, comprising:

receiving a plurality of ion beams of a sample;

magnetically separating the plurality of ion beams;

simultaneously receiving the magnetically separated ion beams in an electrostatic sector at different spatial locations; and increasing the separation between the ion beams using the electrostatic sector, the electrostatic sector being used as a dispersive element following the magnetic separation of the ion beams without regard to the energies of the ions in the beams.

29. The method of claim 28, further comprising:

further increasing the separation between the ion beams output from the electrostatic sector using a plurality of deflection electrostatic sectors; and simultaneously detecting the plurality of ion beams to achieve increased sensitivity and abundance sensitivity.

30. The method of claim 28, wherein the simultaneously receiving comprises receiving each of the ion beams in the electrostatic sector at a different physical location in the electrostatic sector.

31. The method of claim 28, further comprising using pulse counting multipliers to simultaneously measure isotopes of the sample to increase sensitivity and abundance sensitivity of the mass spectrometer.

32. The method of claim 28, further comprising configuring the electrostatic sector to have two at least generally cylindrical sections, and providing a different voltage to each of the at least generally cylindrical sections to cause the plurality of ion beams received in the electrostatic sector to follow the different trajectories.

* * * * *